US005117405A

United States Patent [19]

Thibault

[11] Patent Number: 5,117,405

[45] Date of Patent: May 26, 1992

[54] QUICK RESET GAME TIMER

[76] Inventor: Frank J. Thibault, 13347 Fontaine Dr., Saratoga, Calif. 95070

[21] Appl. No.: 672,552

[22] Filed: Mar. 18, 1991

[51] Int. Cl.[5] ..... G04F 1/04
[52] U.S. Cl. ..... 368/93
[58] Field of Search ..... 368/93–95

[56] References Cited

U.S. PATENT DOCUMENTS

| | | | |
|---|---|---|---|
| 4,117,666 | 10/1978 | Aguilar | 58/141 |
| 4,408,894 | 10/1983 | Hemperly | 368/93 |
| 4,431,313 | 2/1984 | Hemperly | 368/96 |
| 4,527,905 | 7/1985 | Kohls | 368/93 |
| 4,648,721 | 3/1987 | Shapiro | 368/93 |
| 4,813,030 | 3/1989 | Johnson | 368/93 |

*Primary Examiner*—Vit W. Miska

[57] ABSTRACT

A one-piece, quickly resettable gravity-flow timer consisting of a sealed container which integrally houses a base at one end and a reset reservoir at the other and, intermediate these, a receptacle, having a loading orifice nearest the reservoir and a metering orifice nearest the base. The receptacle is partially defined by indentations fo the container in such a way that all flowable medium in the base is instantly directed around the sides of the receptacle, through return channels between the two side walls of the container and the receptacle, and into the reset reservoir upon any manner of inversion of the timer. Partial definition of the receptacle by such indentations makes the timer manufacturable in two-part molds. Baffles between the reservoir and the body of the timer define an aperture positioned above and many times smaller than the loading orifice of the receptacle and direct and flowable medium into the receptacle when the timer is returned from an inverted to an upright position. Minimally, the lower half of the timer is made of a transparent material.

7 Claims, 2 Drawing Sheets

QUICK RESET GAME TIMER

BACKGROUND OF THE INVENTION

1. Field of the Invention

This invention relates to gravity flow timing devices such as the conventional hourglass type sand timer and, in particular, to such a timer designed for economical manufacture and to enable quick resetting when in use.

2. Description of the Prior Art

Timers which depend on the metering of particulate matter through a flow restricting orifice have long existed. Until very recently, those used as game timers have been made of glass as distinguished from plastic, since the fine particular matter used in glass timers had a tendency to cling to the transparent plastics available, thus rendering the timers inaccurate. But glass timers have no provision for being quickly reset when only part of the sand has drained from the upper to the lower chamber. Additionally, the constraints involved in using glass to manufacture such objects have made it infeasible to modify them so as to provide a means for rapidly resetting them.

The fact that glass timers cannot be quickly reset greatly limits their usefulness as game timers. Very often game players using glass timers complete their turns before all the sand has drained from the upper chamber (metering receptacle) into the lower chamber to signify lapse of a time interval. Commencement of another time interval requires delaying the game either until all sand has finished draining from the upper chamber or has been returned to the upper chamber by inversion of the timer, which means, in either case, waiting until the sand has all slowly passed through the small metering opening between the two chambers. Accordingly, to permit quick reset, it is one of the objects of my invention to provide a gravity flow timer having means for free flow return to the metering receptacle of the particulate matter which has drained from it. I have discovered that it is practicable for gravity flow timers to be injection molded from a substantially transparent plastic. Accordingly, since plastics can now replace glass in such timers, it is another object of the invention to provide a variety of practicable configurations to replace the hourglass shape. A still further object is to provide injection moldable configurations that can be mass produced to provide a gravity flow timer adapted for quick resettability.

Gravity flow timers exist which aim to provide for quick resettability. Some of the earlier ones patents, however, required the use of moving parts, as in U.S. Pat. Nos. 2,144,857 and 3,125,849. In addition to any production disadvantages they might have, such timers would tend to be less reliable than gravity flow timers with no moving parts. It is therefore another object of my invention to provide a quickly resettable timer having no moving parts other than the particulate matter it contains, and which may be economically manufactured.

Some one-piece gravity flow timers designed for quick resettability can only be properly reset by rotating the timer carefully in a particular way. This is true of the inventions disclosed in U.S. Pat. Nos. 4,813,030, 4,117,666 and 4,408,894. Accordingly, another object of my invention is the provision of a quickly resettable timer that may be reset simply by inversion and then return to upright position with no special care required in doing so.

There is a timer disclosed in U.S. Pat. No. 4,648,721 which can be easily reset and which has no moving parts, but which requires the separate manufacture and assembly of five parts and which discloses no method for fastening two key parts inside a third part, a problematic operation in mass production manufacture. It is therefore another object of my invention to provide an injection molded timer device that eliminates the necessity of time consuming and therefore costly assembly.

It is therefore a broad object of my invention to provide a timer that will meet the following criteria: easy to mold; simple, i.e. consists of but one piece; constructed from a minimal amount of plastic; reliable; and quickly and easily resettable, no matter how it is inverted or returned to upright in the resetting process.

SUMMARY OF THE INVENTION

It is the intent of this invention to satisfy the criteria listed above. This timer is easy to manufacture because it is simple, i.e. consists of but one part, which can be manufactured in essentially identical halves in the simplest type of two-part, one mold forming the front half of the timer spaced in from timer side walls, the other forming the back half. This is possible because, among other features of the design, indentations in two opposite walls of the timer function also as two of the tapered walls of the metering receptacle inside the timer, thereby eliminating the need to manufacture the receptacle as a separate part and eliminating the concomitant need to then find a practicable means to fasten it inside the timer. Also, primarily because of the double function of the indented outer container walls, the timer of this design is free of any undercut such as would otherwise be necessary in integrally forming a symmetrical receptacle inside the timer housing. Undercuts would preclude the use of simple two-part molds in the manufacturing process because a part made of the rigid kind of plastic required for such timers could not be removed from a two-part mold.

There are some additional advantages to this invention: Since particular matter in a timer with moving parts can get wedged under the moving parts or in other ways interfere with their proper operation, a timer such as this with no moving parts should remain accurate. This timer is not only quickly resettable but resettable with no attention to how the inverting and righting actions are being taken.

Importantly, if such timers are to reach the marketplace, they must be economical to produce. Since this timer requires a minimal amount of plastic and is simple to mold and assemble, it meets that criterian.

REFERENCE NUMERALS IN DRAWINGS

| Quadrilaterial Embodiment | Ovoid Cylinder Embodiment |
|---|---|
| 10 Indentation | 50 Indentation |
| 11 Indentation receptacle wall | 53 Receptacle lip |
| 12 Loading orifice | 55 Indentation floor |
| 14 Metering orifice | 57 Side wall of indentation |
| 15 Indentation floor | 58 Baffle |
| 16 Aperture | 60 Outer container |
| 17 Side wall of indentation | 64 Base |
| 18 Baffle | 66 Reset reservoir |
| 19 Baffle (indented) | 68 Return channel |
| 20 Outer container | |
| 21 Indentation receptacle wall | |
| 22 Metering receptacle | |
| 24 Base | |
| 26 Reset reservoir | |
| 28 Return channel | |
| 29 Receptacle side wall | |
| 32 Modified receptacle | |
| 40 Flowable particulate medium | |
| 61 Modified receptacle upper side wall | |

DESCRIPTION OF THE PREFERRED EMBODIMENT

This gravity flow timer can be quickly reset at any point during its timing operation by any manner of inversion and return to its upright position.

Figure 1:
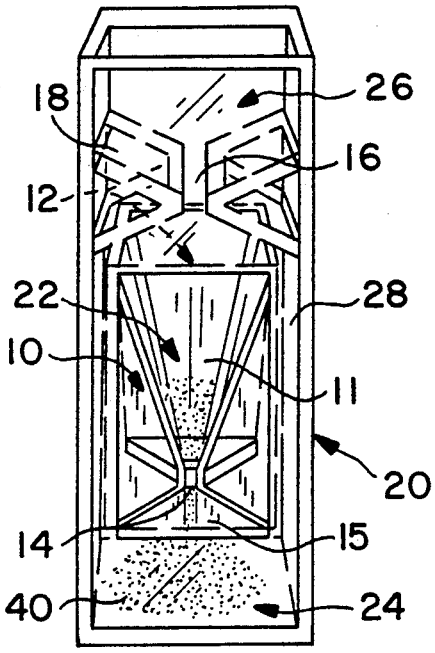
FIG. 1 is a perspective view of my quick reset timer embodied in a quadrilateral housing.
Figure 2:
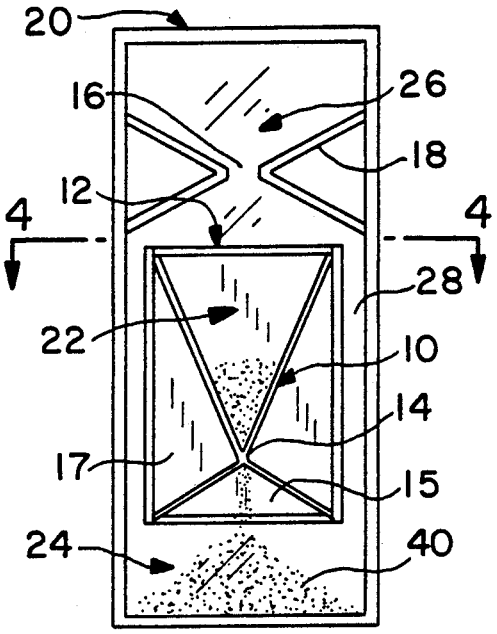
FIG. 2 is a front elevational view of the FIG. 1 embodiment of my timer.

As shown in FIGS. 1 and 2, the timer comprises a sealed quadrilateral outer container designated generally by the numeral 20, which incorporates a reset reservoir 26 formed at one end of the outer container 20, partially defined by baffles 18, an aperture 16, defined by baffles 18; a hollow base 24 at the opposite end, and a metering receptacle 22, partially defined by indented wall portions 10 in two opposing outer container walls 20. All parts of the timer are integrally joined to the container 20.

Preferably, the entire timer should be made of a transparent plastic such as clear styrene. Minimally, the lower half of the timer should be composed of a transparent material so that timer users can see when measurement of a timing period is completed. A quantity of flowable, preferably particulate, medium 40 is sealed within the outer container 20.

To inhibit the clinging of particles of the flowable medium 40 to timer walls from static electricity, and to lessen abrading of the walls by particles of the flowable medium 40, micro-beads of glass or other materials of similar properties are preferred over sand as a flowable medium.

Figure 3:
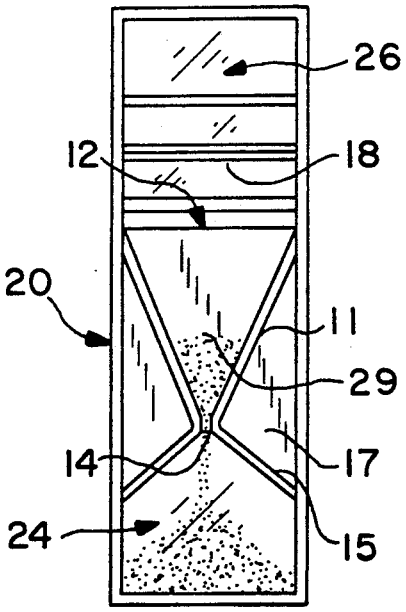
FIG. 3 is a side elevational view of the FIG. 1 embodiment of my timer.

The funnel-like metering receptacle 22 is composed of four, downwardly tapering, perpendicularly connected walls, two of which are formed by indentations 10, as shown in FIGS. 1 and 3, in opposite walls of the outer container 20. The receptacle 22 has a large square loading orifice 12, shown in FIGS. 1 and 2, near the reservoir 26 and a smaller metering orifice 14 near its base end. The metering orifice 14 restricts the movement of the flowable medium 40 through the receptacle 22 for measurement of a time interval.

Baffles 18, positioned above and proximal to the loading orifice 12, partially define the bottom of the reservoir 26, form the aperture 16 between the reservoir 26 and the body of the timer, and serve to direct the flowable medium 40 from the reservoir 26 through the receptacle loading orifice 12 and down into the receptacle 22 upon return of the timer from inverted to upright position.

To accurately direct passage of the flowable medium 40 from the reservoir 26 through the loading orifice 12 and into the receptacle 22, the aperture 16 is slot-like and is positioned above, and as close to the loading orifice 12 as sufficient space for substantially unrestricted passage of flowable medium 40 from the base 24 to the reservoir 26 will permit, and is approximately eight times narrower than the loading orifice 12. To facilitate movement of the flowable medium 40 both into and from the reservoir 26, the baffles 18 have inwardly projecting upper and lower walls which converge toward each other, the walls of each baffle 18 combining integrally with the side wall of the container 20 to form a triangularly-shaped cross section across the entire side wall. As an alternative, baffles 18 designed to form a trapezoidal cross section when combined with the container 20 wall would also permit easy passage of the flowable medium 40 to and from the reservoir 26.

Figure 7:
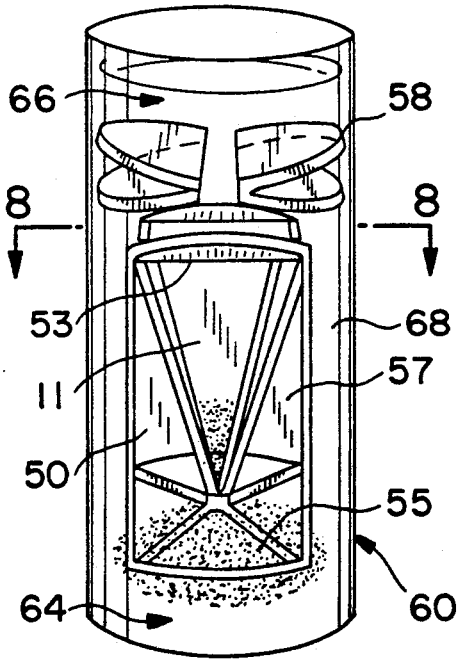
FIG. 7 is a perspective view of an alternative embodiment of my timer.
Figure 8:
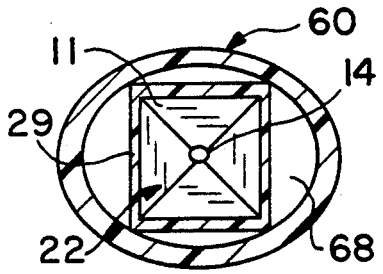
FIG. 8 is a horizontal cross section of FIG. 7 taken at lines 8—8.

In FIGS. 7 and 8, an alternative embodiment of the invention is illustrated, showing the outer container 60 in the shape of an ovoid cylinder. Essentially, this embodiment functions in the same way as the quadrilateral embodiment of FIGS. 1–4. Only modifications necessary to accommodate timer elements to the curvilinearity of the container 60 distinguish this version. These modifications include the following: as shown in FIG. 7, the edges of the baffles 58 which integrally conjoin the interior walls of the container 60 are curved to conform with the interior curvature of the container 60; as shown in FIG. 7, the two receptacle walls 11 formed by opposed indentations 50 of the outer container 60, articulate integrally with the curved walls of the container 60 by means of opposed bow-shaped receptacle lips 53, i.e. a dihedral angle whose outward-and upward-tilting plane terminates in an arc along the juncture with the curved wall of the container 60. As shown in FIG. 7, corresponding with the curved walls of the container 60, in this alternative timer embodiment indentation floors 55 curvilinearly conjoin walls of the container 60 and walls of return channels 68 are curvilinear as shown in FIG. 8.

Figure 5:
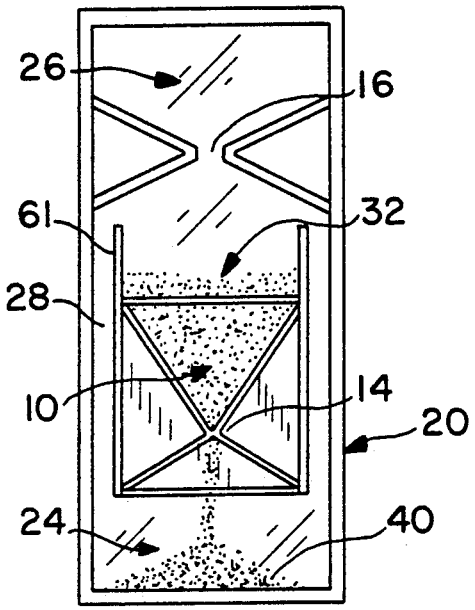
FIG. 5 is a front elevational view of the embodiment of FIG. 1 with a modification of the receptacle.

Various modifications of the embodiments presented at possible. One of these is the receptacle 32 modification shown in FIG. 5, which has a tapered lower portion and laterally spaced upper side walls 61 running parallel to the associated side walls of the container 20. These parallel walls 61 integrally conjoin front walls of the container 20 to define upper extensions of the indentation receptacle walls 11 as shown. This alternative receptacle 32 provides for greater receptacle capacity within the same size outer container 20.

In another capacity-increasing modification of the tapered portion of the receptacle 32 (not shown), receptacle walls may be curvilinearly formed to extend toward their opposites, becoming almost horizontal as they meet to define the metering orifice 14. For this modification, sidewalls of indentations 10, 50 would be correspondingly modified.

As another alternative (not shown), side walls 15, 57 of indentations 10, 50 could be concave or convex, but, preferably, the indentation receptacle walls 11, would be neither concave nor convex because the receptacle side walls 29 could not, for the sake of symmetry, be concave or convex if the timer is to be manufacturable in a two-part mold.

FIG. 2 is a front elevational view of the quadrilateral embodiment of this timer shown in upright position. It shows the reservoir 26, which collects the flowable medium 40 when the timer is inverted, the baffles 18, which partially define the reservoir 26 and form the aperture 16, which, when the timer is returned from an inverted to an upright position, directs the movement of the flowable medium 40 through the loading orifice 12 into the receptacle 22 from where it drains through the metering orifice 14 down into the base 24 as shown.

Figure 4:
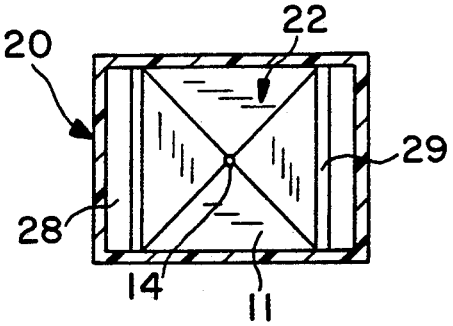
FIG. 4 is a horizontal cross section taken in the plane indicated by the lines 4—4 in FIG. 2.

As shown in FIGS. 2 and 4, the receptacle 22 is spaced in from the associated side walls of the outer container 20, preferably 2–3 milimeters, to provide for return channels 28. The return channels 28 are the passageways by which the quantity of flowable medium which has collected in the base is returned to the reservoir 26 when the timer is inverted in preparation for resetting.

FIG. 3 is a side elevational view of the quadrilateral embodiment of this invention. This view and FIGS. 1 and 7 show the receptacle 22 as constituted by front and back walls of the outer container 20; the two opposing indented receptacle walls 11, formed by indentations 10 in the front and back walls of the outer container 20, function both as receptacle walls 11 and, at the same time, as portions of the outer container 20. As shown in FIGS. 1 and 3, indentation floors 15 of indentations 10 partially define the base 24.

FIG. 4 is a horizontal cross-sectional view of the quadrilateral embodiment of this invention, taken along lines 4—4 of FIG. 2. It shows the square loading orifice 12 of the receptacle 22 and the metering orifice 14 through which the flowable medium 40 passes in the measuring of a time interval. It also shows the space comprising the return channels 28, which run along the sides of the timer, enabling the flowable medium 40 to move easily and completely back to the reservoir 26 when the timer is inverted for reset purposes.

Figure 6:
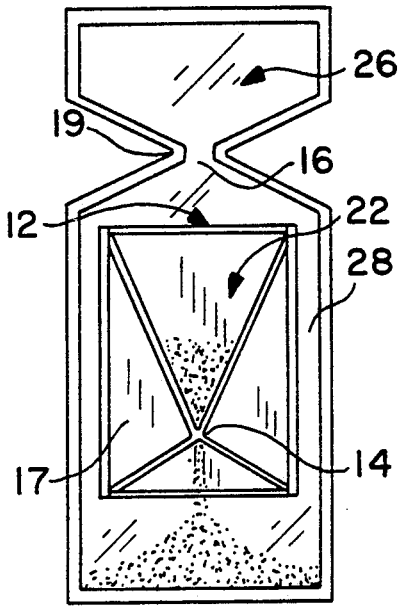
FIG. 6 is a front elevational view of the embodiment of FIG. 1 showing the baffles as defined by the side walls of outer container.

FIG. 6, a front elevational view of an alternative profile of the quadrilateral embodiment of the invention, shows baffles 19 defined by indentations in the side walls of the outer container 20, thereby making baffles 19 and portions of the side walls of the outer container 20 one and the same. Not illustrated, the ovoid cylinder embodiment of the invention could also have, as an alternative, baffles defined by indentations which, in curvilinear form, would corresponds to those shown in FIG. 6.

In both of the main embodiments of this invention, completely constituted, essentially identical, front and back timer halves are formable, and are preferably formed, by injection molding in a two-part mold and are then joined along all container 20, receptacle 22, and baffle 18 (or 19) edges. Alternatively, timer halves are formed with one or both complementary ends open, the open end(s) of the joined timer halves being closed thereafter by means of separately molded caps(s).

In this invention, a flowable medium 40, preferably particulate, moves freely around the receptacle in the outer container 20. When the timer is inverted in any manner whatsoever, all the flowable medium 40 in the base 24, since there are no obstructive surfaces, moves quickly down through the return channels 28, over the receptacle side walls 29, and against the tapered baffles 18, by which it is diverted down through the aperture 16 and into the reset reservoir 26, which now, with the device inverted, is located at the bottom. Simultaneously, any flowable medium remaining in the receptacle 22 also passes back into the reservoir 26.

To be reset, the timer is then turned from its inverted portion to an upright attitude in any manner whatsoever and all the flowable medium 40 is directed by the baffles 18 through the aperture 16 and down through the loading orifice 12 into the receptacle 22 from where it drains at a calculated rate through the metering orifice 14 down into the base 24 for the measurement of a time interval. The time interval measured by a given amount of a particulate medium can be varied by the particle size of the particulate medium 40 and the size of the metering orifice 14.

It is to be understood that many modifications of the particular embodiments of the invention here described and shown may be made without departing from the scope and spirit of the invention as defined in the claims that follow.

What is claimed is:

1. A timer that can be quickly reset which comprises:

a) a sealed outer container having transparent walls defining a hollow interior at a base end and a reset reservoir at the opposite end;

b) a quantity of flowable particulate medium sealed within the walls of the outer container;

c) a metering receptacle within the sealed outer container intermediate the base end and the reservoir end, and constituting the walls of the outer container, and having a relatively large, square loading orifice proximal to the reset reservoir, and being configured to funnel downward to a relatively small metering orifice whereby draining of the flowable medium through the receptacle to the base end of the timer is restricted, said receptacle being spaced from two opposite walls of the outer container so that flowable medium in the base flows around two sides of the receptacle upon inversion of the timer; and d) means for conducting all the flowable medium firstly into the reset reservoir upon inversion of the timer and secondly from the reset reservoir into the receptacle upon righting of the timer by rotation in any direction and in any manner.

2. The timer of claim 1 wherein the outer container has front, back, and side walls, front and back walls being sufficiently wide to provide space for the flowable medium in the base to pass around the sides of the receptacle and return to the reservoir, width of side walls corresponding with width of the loading orifice, said orifice interfacing with front and back container walls.

3. The timer of claim 1 wherein said sealed outer container has ovate walls, front and back wall portions each being obliquely and integrally joined to the loading orifice by an arc-shaped plane.

4. The timer of claim 1 wherein oppositely positioned front and back outer container wall portions are indented so as to also constitute downwardly tapering, converging receptacle walls, spaced in from outer container side walls, said receptacle walls having extending from and between them congruent perpendicular structures complementarily forming the metering receptacle, whereby front and back timer halves can be completely molded in a two-part mold.

5. The timer of claim 1 wherein the reset reservoir is defined by two inwardly projecting, hollow, cross-sectionally V-shaped baffles, oppositely positioned above and proximal to the receptacle, and integrally attached at their bases across the interior side walls of the timer, their apexes defining a slot-like aperture between the reservoir and the main body of the timer.

6. The timer of claim 5 wherein said aperture extends from the front wall to the back wall of the outer container and is sufficiently wide for the flowable medium to flow from the reservoir and is sufficiently narrow for said medium to spread maximally in the direction of said front and back container walls, whereby it is optimally conducted into the receptacle.

7. The timer of claim 1 wherein said means for conducting the flowable medium comprises channels between the receptacle and the side walls of the outer container for transfer of the flowable medium from the base end around the receptacle to the reset reservoir when the timer is inverted, said channels being sufficiently wide to provide for the flowable medium in the base end to flow into the reset reservoir within approximately two or three seconds.

* * * * *